US007152429B2

(12) United States Patent
Paradowski

(10) Patent No.: US 7,152,429 B2
(45) Date of Patent: Dec. 26, 2006

(54) METHOD AND INSTALLATION FOR SEPARATING A GAS CONTAINING METHANE AND ETHANE WITH TWO COLUMNS OPERATING AT TWO DIFFERENT PRESSURES

(75) Inventor: Henri Paradowski, Cergy (FR)

(73) Assignee: Technip France (FR)

( * ) Notice: Subject to any disclaimer, the term of this patent is extended or adjusted under 35 U.S.C. 154(b) by 281 days.

(21) Appl. No.: 10/494,116

(22) PCT Filed: Oct. 11, 2002

(86) PCT No.: PCT/FR02/03490

§ 371 (c)(1),
(2), (4) Date: Apr. 30, 2004

(87) PCT Pub. No.: WO03/038358

PCT Pub. Date: May 8, 2003

(65) Prior Publication Data

US 2005/0000245 A1 Jan. 6, 2005

(30) Foreign Application Priority Data

Oct. 31, 2001 (FR) ..... 01 14141

(51) Int. Cl.
*F25J 25/00* (2006.01)

(52) U.S. Cl. ..... 62/620; 62/630

(58) Field of Classification Search ..... 62/50.2, 62/64, 63, 620, 630

See application file for complete search history.

(56) References Cited

U.S. PATENT DOCUMENTS

| | | | |
|---|---|---|---|
| 4,702,819 | A | 10/1987 | Hill et al. |
| 5,953,935 | A | 9/1999 | Sorensen |
| 6,182,469 | B1 | 2/2001 | Hudson et al. |
| 6,244,070 | B1 | 6/2001 | Chen et al. |

FOREIGN PATENT DOCUMENTS

| | | |
|---|---|---|
| FR | 2 578 637 | 9/1986 |

OTHER PUBLICATIONS

International Search Report dated Feb. 28, 2003.

*Primary Examiner*—Cheryl Tyler
*Assistant Examiner*—Gene Bankhead
(74) *Attorney, Agent, or Firm*—Ostrolenk, Faber, Gerb & Soffen, LLP

(57) ABSTRACT

The invention relates to a method of separating a dry feed gas (1) containing mostly methane, ethane and propane into a first product (17), called the treated gas, which is relatively more volatile, and a second product (34), called fraction C2 plus, which is relatively less volatile. The inventive method comprises: (i) an operation involving the cooling of the supply gas (1) into a cooled gas (2); (ii) an operation whereby the cooled gas (2) from operation (i) is separated and treated; and (iii) distillation in a distillation device (C3). The invention also relates to the corresponding installation. According to the invention, the distillation device (C3) comprises at least first and second distillation columns, (C1) and (C2), which operate at different pressures.

14 Claims, 2 Drawing Sheets

METHOD AND INSTALLATION FOR SEPARATING A GAS CONTAINING METHANE AND ETHANE WITH TWO COLUMNS OPERATING AT TWO DIFFERENT PRESSURES

BACKGROUND OF THE INVENTION

1. Field of the Invention

The present invention relates generally and according to a first aspect to methods of separating a dry feed gas mainly comprising methane, ethane and propane, typically natural gas, and in a second aspect to industrial installations and equipment allowing these methods to be carried out.

2. Description of the Art

More precisely, the invention relates, according to a first aspect, to a method of separating a dry feed gas, mainly comprising methane, ethane, and propane, into a first, relatively more volatile product, called treated gas, and a second, relatively less volatile product, called C2 plus fraction, comprising:

(i) an operation for cooling the feed gas, turning it into a cooled gas, (ii) an operation for separating and treating the cooled gas produced by operation (i), this cooled gas being separated into a first, essentially liquid bottom stream and a first, essentially gaseous top stream, the first bottom stream then being at least partially expanded in order to form a first cooled bottom stream, the first top stream being separated into a main stream and a secondary stream, the main stream being expanded in a turbine in order to form an expanded main stream, and the secondary stream being cooled in an exchanger, then expanded in order to form an expanded secondary stream, (iii) a distillation operation in a distillation device producing a second top stream and a second bottom stream, the distillation device being fed by at least part of the expanded main stream, by at least part of the cooled bottom stream, and by at least part of the expanded secondary stream, the cooled bottom stream being at a relatively less cold temperature than the expanded main stream and the expanded secondary stream being at a relatively colder temperature than the expanded main stream, the second top stream cooling the secondary stream in the exchanger then, after reheating and a plurality of compression and cooling stages, forming the first product, with the second bottom stream, after compression and reheating, forming the second product.

According to a second aspect, the invention relates to an installation for separating a dry feed gas, mainly comprising methane, ethane and propane, into a first, relatively more volatile product, called treated gas, and a second, relatively less volatile product, called C2 plus fraction, comprising:

(i) means for cooling the feed gas, turning it into a cooled gas, (ii) means for separating and treating the cooled gas produced by stage (i), this cooled gas being separated into a first, essentially liquid bottom stream and a first, essentially gaseous top stream, the first bottom stream then being at least partially expanded in order to form a first cooled bottom stream, the first top stream being separated into a main stream and a secondary stream, the main stream being expanded in a turbine in order to form an expanded main stream, and the secondary stream being cooled in an exchanger, then expanded in order to form an expanded secondary stream, (iii) a distillation device producing a second top stream and a second bottom stream, the distillation device being fed by at least part of the expanded main stream, by at least part of the cooled bottom stream, and by at least part of the expanded secondary stream, the cooled bottom stream being at a relatively less cold temperature than the expanded main stream and the expanded secondary stream being at a relatively colder temperature than the expanded main stream, the second top stream cooling the secondary stream in the exchanger then, after reheating and a plurality of compression and cooling stages, forming the first product, the second bottom stream, after compression and reheating, forming the second product.

This method and the installation which carries it out are known from the prior art, in particular from U.S. Pat. No. 4,157,904. This patent discloses several methods and their corresponding installations having the characteristics described above, these methods also providing for mixing part of the first bottom stream with the secondary stream prior to cooling, expansion and feeding into the distillation device.

The distillation device used by these methods is formed by a distillation column. The secondary stream is introduced at the top of the column and acts as a reflux and the main flux is introduced at an intermediary stage. The cooled first bottom stream is introduced at a lower stage to the main stream.

The top of the column, between the introduction stage of the main stream and the introduction stage of the secondary stream, acts as an extraction zone for C2 and higher hydrocarbons from the main stream, and the bottom of the column, below the main stream introduction stage, acts as a methane-removal zone.

The ethane and propane extraction efficiencies can be increased by lowering the temperature profile of the column. This requires a lot of energy if the power of the cooling cycle used to cool the feed gas is simply increased.

Another way of lowering this profile is to expand the streams feeding the distillation column to a larger extent, whereby these streams are cooled but the operating pressure of the column is also reduced. The power required for recompressing the first product will therefore increase.

U.S. Pat. No. 4,157,904 proposes plans allowing this profile to be lowered by optimising energy efficiency, mainly by mixing part of the first bottom stream with the secondary stream prior to cooling, expansion and feeding into the distillation device, which, as a result of the physico-chemical properties of these streams, allows lower temperatures for feeding the distillation column to be reached without having an adverse effect on the operating pressure.

By contrast, the reflux, formed by the mixture of part of the first bottom stream and the secondary stream, is richer in C2 and higher hydrocarbons than the secondary stream alone, which has an adverse effect on the extraction of C2 and higher hydrocarbons from the main stream in the top zone of the column.

SUMMARY OF THE INVENTION

In this context, it is the aim of the present invention to optimise both the ethane and propane extraction efficiency and the energy efficiency of the method and corresponding installation.

To this effect, the invention, according to a first aspect, furthermore in accordance with the generic definition given above, is essentially characterised in that the distillation device of the separation method comprises at least first and second distillation columns operating at different pressures.

In one possible embodiment of the method according to the invention, the first and second distillation columns operate at pressures P1 and P2 respectively, the difference between P1 and P2 being between 5 and 25 bar.

According to one of the advantageous aspects of the method according to the invention, operating pressure P1 of the first distillation column can be between 30 and 45 bar.

According to one the advantageous aspects of the method according to the invention, operating pressure P2 of the second distillation column can be between 15 and 30 bar.

According to one the advantageous aspects according to the invention, the second distillation column can produce a fourth top stream and a fourth bottom stream, the fourth bottom stream forming the second bottom stream produced by the distillation device, at least part of the fourth top stream feeding, after compression and at least partial liquefaction, a top stage of the first distillation column.

According to one of the advantageous aspects of the method according to the invention, the first distillation column can produce a third top stream and a third bottom stream, the third top stream forming the second top stream produced by the distillation device, the first distillation column being fed at a lower stage by at least part of the expanded main stream and at an intermediary stage by at least part of the expanded secondary stream.

According to one of the advantageous aspects of the method according to the invention, the second distillation column can be fed at an upper stage by at least part of the third bottom stream produced by the first distillation column, and at an intermediary stage by at least part of the first cooled bottom stream.

According to one the advantageous aspects of the method according to the invention, the second distillation column can comprise at least a reboiler.

According to one the advantageous aspects of the method according to the invention, the fourth top stream can release part of its cooling potential in the exchanger prior to compression.

According to one of the advantageous aspects of the method according to the invention, the fourth top stream after compression can undergo a plurality of cooling stages, with at least one in the exchanger, then expansion before feeding the first distillation column.

The invention, according to a second aspect, furthermore in accordance with the generic definition given above, is essentially characterised in that the distillation device of the separation installation comprises at least first and second distillation columns operating at different pressures.

In one possible embodiment of the installation according to the invention, the first and second distillation columns operate at pressures P1 and P2 respectively, the difference between P1 and P2 being between 5 bar and 25 bar.

According to one of the advantageous aspects of the installation according to the invention, operating pressure P1 of the first distillation column can be between 30 and 45 bar.

According to one of the advantageous aspects of the installation according to the invention, operating pressure P2 of the second distillation column can be between 15 and 30 bar.

According to one of the advantageous aspects of the installation according to the invention, the second distillation column can produce a fourth top stream and a fourth bottom stream, the fourth bottom stream forming the second bottom stream produced by the distillation device, at least part of the fourth top stream feeding, after compression and at least partial liquefaction, a top stage of the first distillation column.

According to one of the advantageous aspects of the installation according to the invention, the first distillation column can produce a third top stream and a third bottom stream, the third top stream forming the second top stream produced by the distillation device, the first distillation column being fed at a lower stage by at least part of the expanded main stream and at an intermediary stage by at least part of the expanded secondary stream.

According to one of the advantageous aspects of the installation according to the invention, the second distillation column can be fed at an upper stage by at least part of the third bottom stream produced by the first distillation column, and at an intermediary stage by at least part of the first cooled bottom stream.

According to one of the advantageous aspects of the installation according to the invention, the second distillation column can comprise at least a reboiler.

According to one of the advantageous aspects of the installation according to the invention, the fourth top stream can release part of its cooling potential in the exchanger prior to compression.

According to one of the advantageous aspects of the installation according to the invention, the fourth top stream after compression can undergo a plurality of cooling stages, with at least one in the exchanger, then expansion, prior to feeding the first distillation column.

BRIEF DESCRIPTION OF THE DRAWINGS

Other characteristics and advantages of the invention will emerge clearly from the following description by way of informative and non-limiting example with reference to the appended figures, in which.

DESCRIPTION OF THE EMBODIMENTS

Figure 1:
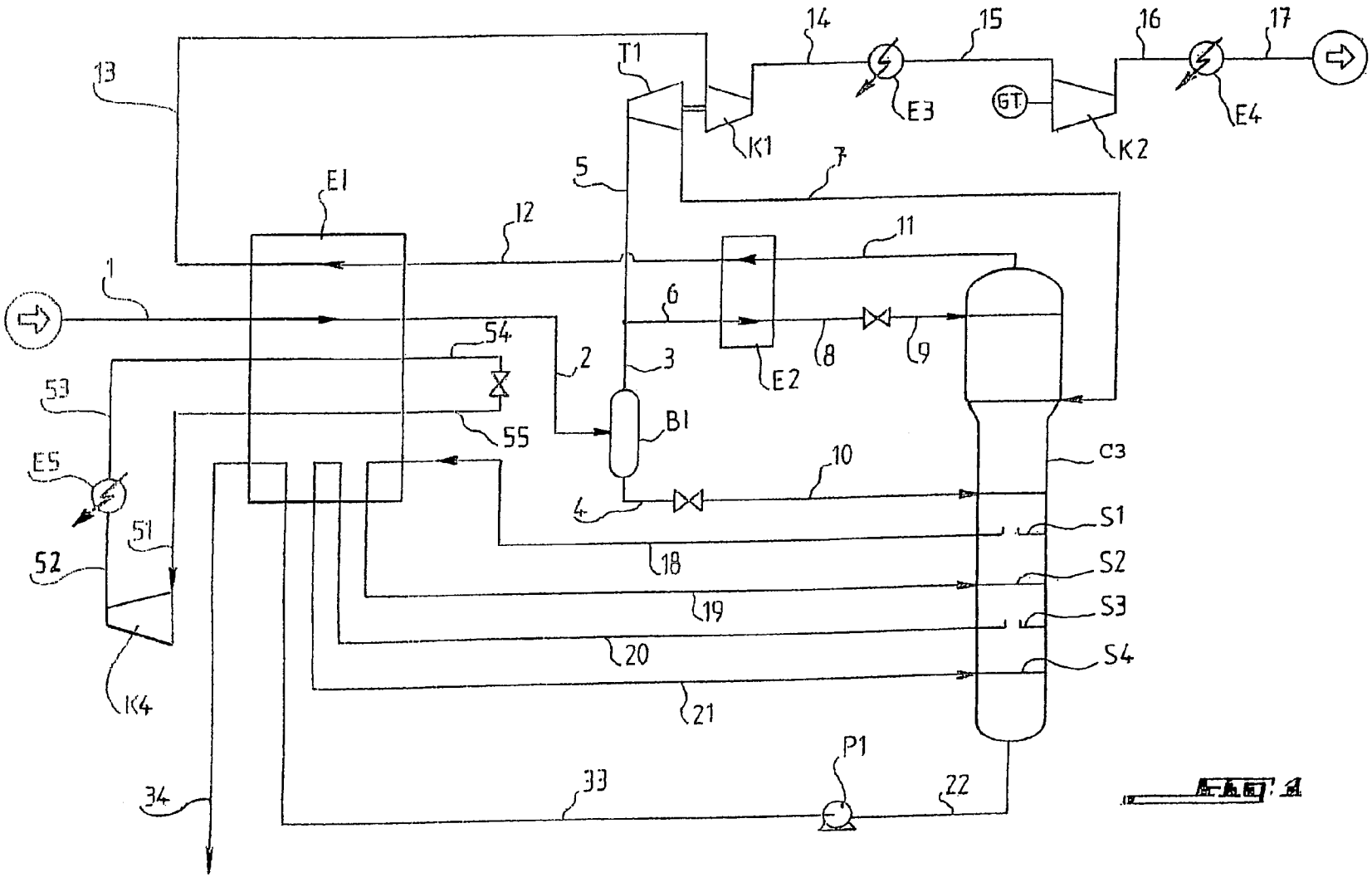
FIG. 1 shows a skeleton diagram of a gas-separation installation according to the prior art

A conventional separation method according to the prior art will first be described with reference to FIG. 1.

The flow rate values, temperature values, pressure values and composition values given in the description below are values obtained by numerical simulation of the method in an embodiment shown in FIG. 1.

This method is fed by a feed gas stream 1, typically natural gas, mainly containing methane, ethane and propane. This gas arrives in a dry form and typically has the following characteristics: pressure 73 absolute bar, temperature 40° C., flow rate 30000 kgmol/h.

The approximate molar flow rates in kgmol/h of the main components of the feed gas are given in the table below.

| $N_2$ | $CO_2$ | Methane | Ethane | Propane | i-Butane | n-Butane | i-Pentane | n-Pentane | n-Hexane | n-Heptane |
|---|---|---|---|---|---|---|---|---|---|---|
| 1200 | 300 | 25800 | 1650 | 600 | 120 | 120 | 60 | 60 | 30 | 30 |

The method produces two products: a first product 17, called treated gas, formed mainly by methane and depleted in C2 and higher hydrocarbons in comparison to feed gas 1, notably ethane and propane, and a second product 34, called C2 plus fraction, mainly formed by ethane and propane and containing most of the C2 and higher hydrocarbons provided by feed gas 1.

Feed gas 1 undergoes a first cooling operation to a temperature of minus 50° C. in a cryogenic exchanger E1 in order to produce a cooled gas stream 2. A fraction of the gas is condensed during this operation, approximately 10%, the less volatile components being condensed to a greater extent than the more volatile components.

This cooled gas 2 then undergoes a second separation and treatment operation. Cooled gas stream 2 is separated in a separator reservoir B1 into a first top stream 3 relatively depleted in C2 and higher hydrocarbons and a first bottom stream 4 relatively enriched in C2 and higher hydrocarbons.

First top stream 3 is essentially gaseous, and the first bottom stream is essentially liquid and their flow rates are approximately 27000 and 3000 kgmol/h respectively.

First bottom stream 4 then undergoes expansion to a pressure of 25 absolute bar, which causes cooling to minus 80° C. and partial vapourisation of approximately 45% of the liquid in order to form a first cooled bottom stream 10.

First top stream 3 is divided into a main stream 5 and a secondary stream 6 with flow rates of 20000 kgmol/h and 7000 kgmol/h respectively. Main stream 5 is expanded to a pressure of 25 absolute bar in a turbine T1 coupled to a compressor K1 in order to form an expanded main stream 7. This expansion is accompanied by cooling to minus 92° C. and partial condensation of approximately 20% of the gas.

Secondary stream 6 is cooled and liquefied in a second cryogenic exchanger E2 to minus 99° C. in order to form a stream 8, this resulting stream 8 then being expanded to 25 absolute bar, turning it into an expanded secondary stream 9. This expansion is accompanied by cooling to minus 103° C. and partial vapourisation of approximately 6% of the liquid.

The various streams produced by the separation and treatment operation then undergo distillation in a distillation device C3, typically a distillation column in the prior art.

Expanded main stream 7 feeds distillation device C3 at an intermediary stage, expanded secondary stream 9 feeding distillation device C3 at a top stage and forming a reflux.

First cooled bottom stream 10 feeds distillation device C3 at an intermediary stage situated under the feed stage of expanded main stream 7.

Distillation device C3 operates under 25 absolute bar and is typically equipped with two reboilers formed by zones of cryogenic exchanger E1 in the embodiment illustrated in FIG. 1.

The first reboiler is fed by a stream 18 with a flow rate of approximately 7000 kgmol/h and a temperature of minus 56° C., drawn off at a stage S1 situated under the feed stage of first cooled bottom stream 10, the reheated stream forming a stream 19 with a temperature of minus 19° C. which feeds a stage S2 situated at a lower level than stage S1.

The second reboiler is fed with a stream 20 with a flow rate of 4000 kgmol/h and a temperature of 5° C., drawn off at a stage S3 situated at a lower level than stage S2, the reheated stream forming a stream 21 with a temperature of 14° C. which feeds a stage S4 situated at lower level than stage S3.

Distillation device C3 produces a second, essentially gaseous, top stream 11 and a second, essentially liquid, bottom stream 22 with flow rates of 27200 kgmol/h and 2800 kgmol/h respectively.

Second top stream 11 is relatively depleted in C2 and higher hydrocarbons, and second bottom stream 22 is relatively enriched in C2 and higher hydrocarbons.

Second bottom stream 22, with a temperature of 14° C. and a pressure of 25 absolute bar, after compression to 35 absolute bar by a pump P1 turning it into a stream 33 and reheating to 32° C. in exchanger E1, forms second product 34.

The subsequent operations for treating second current 34, which are not covered by the present invention and, therefore, are not described, establishes a molar ratio between C1 hydrocarbons and C2 hydrocarbons of approximately 0.01 in this second current 34.

Second top stream 11 releases part of its calorific potential to secondary stream 6 in cryogenic exchanger E2 in order to form a stream 12 with a temperature of minus 73° C., then undergoes a second reheating stage to 33° C. in cryogenic exchanger E1 in order to form a stream 13.

This stream 13 is compressed to 30 absolute bar in compressor K1 coupled to turbine T1, turning it into a stream 14, and cooled to 40° C. by exchanger E3, turning it into a stream 15.

This stream 15 undergoes a second compression to 75 absolute bar by a compressor K2, turning it into a stream 16, whereby said compressor can, for example, be coupled to a gas turbine GT, then cooled to 45° C. by exchanger E4 and forms first product 17.

In accordance with the operating conditions, a cooling cycle provides cryogenic exchanger E1 with the additional cooling power necessary to cool feed gas 1.

This cycle is not useful in the operating conditions described above, but the description thereof is nevertheless given below.

A stream 51 of gaseous propane is compressed to 14 absolute bar by a compressor K4, typically equipped with an electric motor, in order to produce a stream 52, then cooled to 40° C. by an exchanger E5, turning it into a liquid stream 53.

Stream 53 is cooled to minus 20° C. in cryogenic exchanger E1 in order to form stream 54 which is then expanded to 4 absolute bar, turning it into a stream 55.

Stream 55 is vapourised in cryogenic exchanger E1 to form stream 51 with a temperature of minus 6° C.

The flow rates for components of the main streams of the method are indicated in the table below in kgmol/h:

| Stream: | $CO_2$ | Methane | Ethane | Propane |
|---|---|---|---|---|
| 7 | 190 | 17600 | 960 | 270 |
| 9 | 66 | 6170 | 340 | 95 |

-continued

| Stream: | $CO_2$ | Methane | Ethane | Propane |
|---|---|---|---|---|
| 10 | 49 | 2080 | 360 | 230 |
| 17 | 77 | 25800 | 120 | 5 |
| 34 | 220 | 15 | 1530 | 590 |

The method according to the invention will now be described with reference to FIG. 2. Only the parts which are different from the prior art will be described in detail. The streams carrying out a function identical to that carried out in the method according to the prior art will keep the same reference number.

The method is fed with a feed gas stream 1 having the same properties as that described above.

The operations for cooling feed gas 1 and separating and treating cooled gas 2 are identical to those of the prior art. Only the operational conditions change, as will be described below.

First bottom stream 4 is expanded to 20 absolute bar, whereby the temperature of first cooled bottom stream 10 is brought to minus 86° C.

The flow rates of main stream 5 and secondary stream 6 are 26000 kgmol/h and 1000 kgmol/h respectively. Main stream 5 is expanded to 38.5 absolute bar, whereby the temperature of expanded main stream 7 is brought to minus 77° C.

Secondary stream 6 is cooled in cryogenic exchanger E2 to minus 91° C. and expanded to 38.5 absolute bar, whereby the temperature of expanded secondary stream 9 is brought to minus 92° C.

Distillation device C3 comprises first and second distillation columns C1 and C2 operating under pressures P1 and P2 of 38.5 and 20 absolute bar respectively.

First distillation column C1 produces a third top stream 11 and a third bottom stream 23 with flow rates of 27300 and 8000 kgmol/h respectively, and second distillation column C2 produces a fourth top stream 25 and a fourth bottom stream 22 with flow rates of 8310 and 2730 kgmol/h respectively.

Second distillation column C2 is fed with first cooled bottom stream 10 at an intermediary stage and with a third expanded bottom stream 24 at an upper stage. Third expanded bottom stream 24 is produced by expanding to 20 absolute bar and minus 98° C. third bottom stream 23 which exits first distillation column C1 at 38.5 absolute bar and minus 78° C.

Fourth bottom stream 22 exits at 20 absolute bar and 5° C.

Fourth top stream 25, with a temperature of minus 97° C. and a pressure of 20 absolute bar, releases part of its cooling potential in cryogenic exchanger E2 in order to form stream 26 at minus 60° C.

This stream 26 is then reheated in cryogenic exchanger E1 to 38° C., turning it into a stream 27 which is then compressed to 50 bar and 128° C. by a compressor K3 in order to form a stream 28. Compressor K3 is typically equipped with an electric motor.

Stream 28 is then cooled to 40° C. by an exchanger E6 in order to produce a stream 29, undergoes a second cooling stage to minus 50° C. in cryogenic exchanger E1, turning it into a stream 30, this stream 30 undergoing a third cooling stage to minus 91° C. in cryogenic exchanger E2, turning it into a stream 31.

Stream 31, after expansion to 38.5 absolute bar and minus 92° C., forms a stream 32 which feeds a top stage of first distillation column C1.

First distillation stage C1 is also fed with expanded main stream 7 at a lower level, and with expanded secondary stream 9 at an intermediary level.

Third top stream 11 exits first distillation column C1 at minus 89° C. and 38.5 absolute bar and undergoes treatment identical to the treatment described for the prior art.

Stream 11 is reheated to minus 69° C. in order to form stream 12, stream 12 being reheated to 38° C. in order to form stream 13.

This stream 13 undergoes two successive compressions by compressors K1 and K2 to 44 absolute bar and 51° C. then 75 absolute bar and 96° C., each compression being followed by cooling to 40° C. and 45° C. respectively.

Fourth bottom stream 22 is compressed and reheated to 35° C. and 35 bar.

It will be noted that first and second products 17 and 34 are produced under the same temperature and pressure conditions as for the method according to the prior art, thereby allowing a comparison of the energy results.

Figure 2:
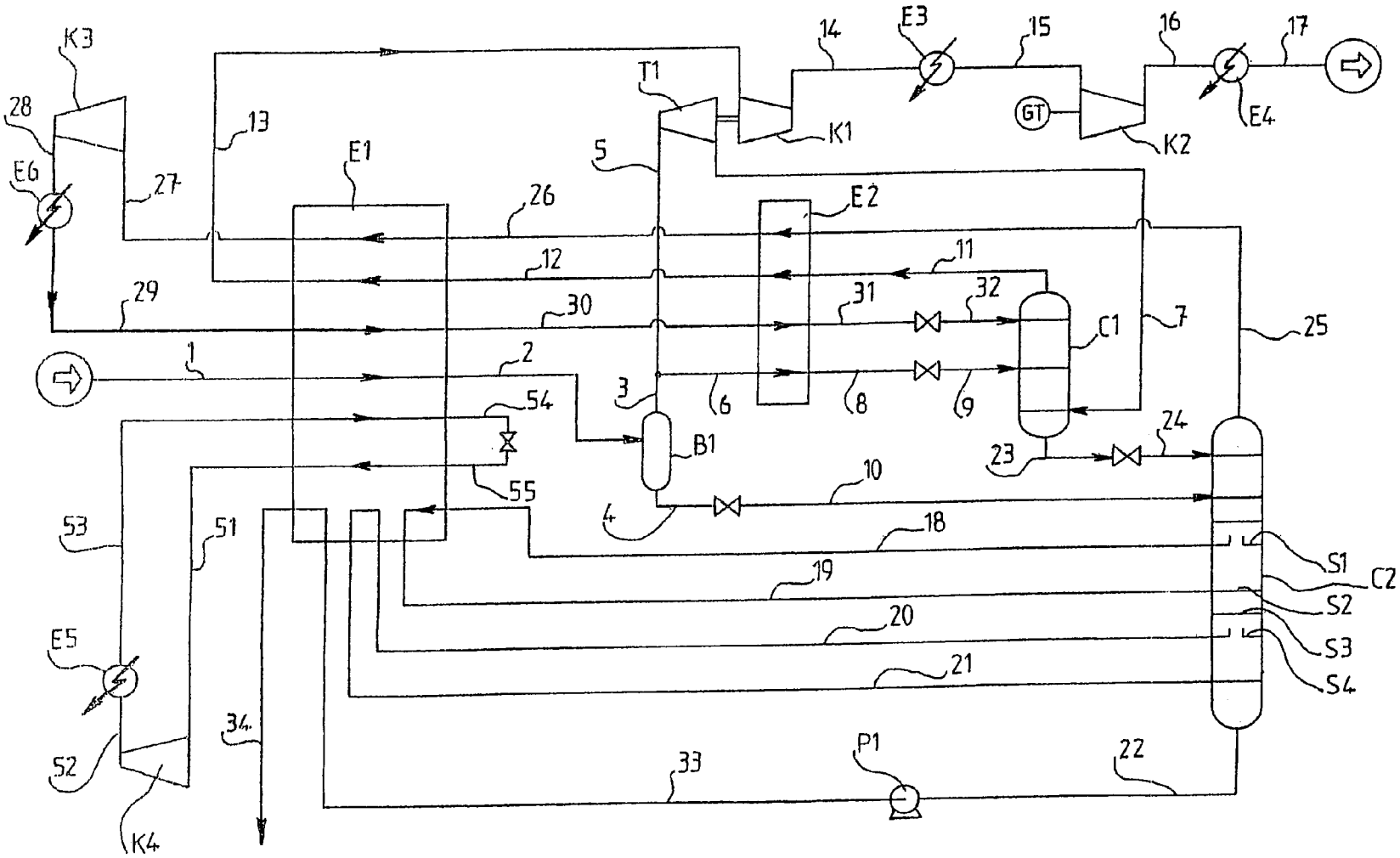
FIG. 2 shows a skeleton diagram of a gas-separation installation according to the invention.

Second distillation column C2 is equipped with two reboilers formed by zones of cryogenic exchanger E1 in the embodiment illustrated in FIG. 2.

The first reboiler is fed by stream 18 with a flow rate of approximately 5700 kgmol/h and a temperature of minus 55° C., drawn off at a stage S1 situated below the feed stage of first cooled bottom stream 10, the reheated stream forming stream 19 with a temperature of minus 20° C. which feeds a stage S2 situated at a lower level than stage S1.

The second reboiler is fed with stream 20 with a flow rate of 3600 kgmol/h and a temperature of minus 3° C., drawn off at a stage S3 situated at a lower level than stage S2, the reheated stream forming stream 21 with a temperature of 5° C. which feeds a stage S4 situated at a lower level than stage S3.

The flow rates for components of the main streams of the method are given in the table below in kgmol/h:

| Stream: | $CO_2$ | Methane | Ethane | Propane |
|---|---|---|---|---|
| 7 | 250 | 22900 | 1240 | 350 |
| 9 | 9 | 880 | 48 | 14 |
| 10 | 44 | 2080 | 360 | 230 |
| 17 | 140 | 25800 | 120 | 1 |
| 23 | 170 | 5920 | 1290 | 370 |
| 25 | 48 | 7990 | 120 | 4 |
| 34 | 160 | 15 | 1530 | 600 |

Another example of operation of the method according to the invention will be described below, operating pressure P1 of first distillation column C1 still being 38.5 absolute bar and operating pressure P2 of second distillation column C2 being 25 absolute bar.

The properties of the main streams are grouped together in the table below.

| Stream: | Temperature | Pressure | Total flow rate |
|---|---|---|---|
| 7 | Minus 77° C. | 39 absolute bar | 25500 kgmol/h |
| 9 | Minus 90° C. | 39 absolute bar | 1500 kgmol/h |
| 10 | Minus 81° C. | 25 absolute bar | 3000 kgmol/h |
| 17 | 45° C. | 75 absolute bar | 27200 kgmol/h |
| 23 | Minus 79° C. | 39 absolute bar | 9100 kgmol/h |

-continued

| | | | |
|---|---|---|---|
| 25 | Minus 92° C. | 25 absolute bar | 9400 kgmol/h |
| 34 | 35° C. | 34 absolute bar | 2760 kgmol/h |

| Stream: | $CO_2$ | Methane | Ethane | Propane |
|---|---|---|---|---|
| 7 | 240 | 22400 | 1220 | 350 |
| 9 | 14 | 1320 | 72 | 20 |
| 10 | 44 | 2080 | 360 | 230 |
| 17 | 110 | 25800 | 110 | 1 |
| 23 | 200 | 6910 | 1330 | 370 |
| 25 | 63 | 8980 | 150 | 6 |
| 34 | 190 | 15 | 1540 | 600 |

In this example of operation, the related cooling cycle is used, the propane flow rate being approximately 550 kgmol/h in the loop.

The comparison of the main properties of the method according to the prior art and of the two cases of operation of the method according to the invention shows that, for similar levels of ethane and propane extraction, the method according to the invention allows a considerable saving in power and, therefore, savings in cost.

| | | Prior art | Invention First case | Invention Second case |
|---|---|---|---|---|
| Pressure of C1 | bar | 25* | 38.5 | 38.5 |
| Pressure of C2 | bar | 25* | 20 | 25 |
| Difference in pressure between C1 and C2 | bar | 0 | 18.5 | 13.5 |
| Flow rate of stream 6 | kgmol/h | 7000 | 1000 | 1500 |
| Level of ethane recovery | % | 92.8 | 92.7 | 93.3 |
| Level of propane recovery | % | 99.2 | 99.8 | 99.8 |
| Power K2 | kW | 27444 | 14937 | 14916 |
| Power K3 | kW | 0 | 7663 | 6681 |
| Power K4 | kW | 0 | 0 | 500 |
| Total power | kW | 27444 | 22600 | 22097 |

*Pressure of distillation device C3

The saving in power achieved with the method according to the invention is approximately 5000 kW in contrast to the prior art for the considered flow rates.

Other variations are included in the present invention.

Operating pressure P1 of distillation column C1 can vary from 30 to 45 bar and operating pressure P2 of distillation column C2 can vary from 15 to 30 bar. The energy efficiency is better when the difference between P1 and P2 is between 5 and 25 bar.

The fact that a first distillation column C1 is used at a higher pressure P1 allows savings to be made for the final compression of first product 17 with these savings largely counterbalancing the cost of the intermediary compression of fourth top stream 25.

Furthermore, the method benefits in terms of its separating performance from the fact that fourth top stream 25, used as a reflux in first distillation column C1, is extremely depleted in C2 and higher hydrocarbons, as shown in the following table:

| | | Prior art | Invention First case | Invention Second case |
|---|---|---|---|---|
| Ethane content of the fourth top stream | molar % | — | 1.46 | 1.60 |
| Ethane content of the first top stream | molar % | 4.8* | 4.8 | 4.8 |

*used as a top reflux

The invention claimed is:

1. A method of separating a dry feed gas, which mainly includes methane, ethane and propane, into a first, relatively more volatile treated gas, and into a second, relatively less volatile product, called C2 plus fraction, said method comprising:

(i) cooling said dry feed gas, for turning said dry feed gas into a cooled gas;

(ii) separating and treating said cooled gas produced by said cooling step, by separating said cooled gas into a first, essentially liquid, bottom stream and a first, essentially gaseous, top stream; then at least partially expanding said first bottom stream in order to form a first cooled bottom stream; and separating said first top stream into a main stream and a secondary stream, expanding said main stream in a turbine in order to form an expanded main stream, and cooling said secondary stream in an exchanger and then expanding said secondary stream in order to form an expanded secondary stream; and (iii) producing in a distillation device a second top stream and a second bottom stream, feeding said distillation device by at least part of said expanded main stream, by at least part of said first cooled bottom stream, and by at least part of said expanded secondary stream wherein said distillation device comprises a first distillation column operating at pressure P1; said first cooled bottom stream being at a relatively less cold temperature than said expanded main stream and said expanded secondary stream being at a relatively colder temperature than said expanded main stream; said second top stream cooling said secondary stream in said exchanger and then, after reheating and a plurality of compression and cooling stages, forming said first product; said second bottom stream, after compression and reheating, forming said second product; wherein said distillation device further comprises at least a second distillation column operating at pressure P2, a difference between P1 and P2 being between 5 and 25 bar; wherein said second distillation column produces a fourth top stream and a fourth bottom stream, said fourth bottom stream forming the said second bottom stream produced by said distillation device, at least part of said fourth top stream feeding, after compression and at least partial liquefaction, a top stage of said first distillation column; and wherein said first distillation column produces a third top stream and a third bottom stream, said third top stream forming said second top stream produced by said distillation device, said first distillation column being fed at a lower stage by at least part of said expanded main stream and at an intermediary stage by at least part of said expanded secondary stream.

2. The separation method according to claim 1, wherein said operating pressure P1 of said first distillation column is between 30 and 45 bar.

3. The separation method according to claim 1, wherein said operating pressure P2 of said second distillation column is between 15 and 30 bar.

4. The separation method according to claim 1, wherein said second distillation column is fed at an upper stage by at least part of said third bottom stream produced by said first distillation column, and at an intermediary stage by at least part of said first cooled bottom stream.

5. The separation method according to claim 1, wherein said second distillation column comprises at least a reboiler.

6. The separation method according to claim 1, wherein said fourth top stream releases part of its cooling potential in said exchanger prior to compression.

7. The separation method according to claim 1, wherein said fourth top stream, after compression, undergoes a plurality of cooling stages, with at least one in said exchanger, and then expansion before feeding said first distillation column.

8. An installation for separating a dry feed gas, which mainly includes methane, ethane and propane, into a first, relatively more volatile product, called treated gas, and a second, relatively less volatile product, called C2 plus fraction, said installation comprising:

(i) means for cooling said dry feed gas, thereby turning said dry feed gas into a cooled gas;

(ii) means for separating and treating said cooled gas produced by said cooling means, in which means said cooled gas is separated into a first, essentially liquid, bottom stream and a first, essentially gaseous, top stream; said first bottom stream then being at least partially expanded to form a first cooled bottom stream; and said first top stream being separated into a main stream and a secondary stream, a turbine in which said main stream is expanded in order to form an expanded main stream, and an exchanger in which said secondary stream is cooled in an exchanger and then expanded in order to form an expanded secondary stream; and (iii) a distillation device operable for producing a second top stream and a second bottom stream, said distillation device being fed by at least part of said expanded main stream, by at least part of said first cooled bottom stream, and by at least part of said expanded secondary stream, and comprising a first distillation column operating at pressure P1, wherein said first cooled bottom stream is at a relatively less cold temperature than said expanded main stream and said expanded secondary stream is at a relatively colder temperature than said expanded main stream; said second top stream cooling said secondary stream in said exchanger and then, after reheating and a plurality of compression and cooling stages, forming said first product; said second bottom stream, after compression and reheating, forming said second product; wherein said distillation device further comprises at least a second distillation column operating at pressure P2, a difference between P1 and P2 being between 5 and 25 bar; wherein said second distillation column produces a fourth top stream and a fourth bottom stream, said fourth bottom stream forming said second bottom stream produced by said distillation device, at least part of said fourth top stream feeding, after compression and at least partial liquefaction, a top stage of said first distillation column; and wherein said first distillation column produces a third top stream and a third bottom stream, said third top stream forming the said second top stream produced by said distillation device, said first distillation column being fed at a lower stage by at least part of said expanded main stream and at an intermediary stage by at least part of said expanded secondary stream.

9. The separation installation according to claim 8, wherein said operating pressure P1 of said first distillation column is between 30 and 45 bar.

10. The separation installation according to claim 8, wherein said operating pressure P2 of said second distillation column is between 15 and 30 bar.

11. The separation installation according to claim 8, wherein said second distillation column is fed at an upper stage by at least part of said third bottom stream produced by said first distillation column, and at an intermediary stage by at least part of said first cooled bottom stream.

12. The separation installation according to claim 8, wherein said second distillation column comprises at least a reboiler.

13. The separation installation according to claim 8, wherein said fourth top stream releases part of its cooling potential in said exchanger prior to compression.

14. The separation installation according to claim 8, characterised in that wherein said fourth top stream, after compression, undergoes a plurality of cooling stages, with at least one in said exchanger, and then expansion before feeding said first distillation column.

* * * * *